United States Patent [19]

Bengtsson

[11] Patent Number: 4,596,295

[45] Date of Patent: Jun. 24, 1986

[54] ROLLER CUTTER WITH A TILTED JOURNAL

[75] Inventor: Ulf A. Bengtsson, Motala, Sweden

[73] Assignee: Santrade Limited, Lucerne, Switzerland

[21] Appl. No.: 626,917

[22] Filed: Jul. 2, 1984

[30] Foreign Application Priority Data

Jul. 1, 1983 [SE] Sweden ..... 8303763

[51] Int. Cl.[4] ..... E21B 10/10; E21B 10/20

[52] U.S. Cl. ..... 175/361; 175/376

[58] Field of Search ..... 175/343, 361, 364, 365, 175/376, 378

[56] References Cited

U.S. PATENT DOCUMENTS

| | | | |
|---|---|---|---|
| 1,322,696 | 11/1919 | Hughes | 175/353 |
| 1,920,164 | 7/1933 | Stancliff | 175/359 |
| 2,038,408 | 4/1936 | Berleth | 175/359 |
| 2,052,034 | 8/1936 | Pennington | 175/350 |
| 2,061,650 | 11/1936 | Catland | 175/343 X |
| 3,430,718 | 3/1969 | Lawrence | 175/343 |
| 4,274,496 | 6/1981 | Liljekvist et al. | 175/376 X |
| 4,448,269 | 5/1984 | Ishikawa et al. | 175/376 X |

*Primary Examiner*—Stuart S. Levy
*Assistant Examiner*—David Werner
*Attorney, Agent, or Firm*—Burns, Doane, Swecker & Mathis

[57] ABSTRACT

The present invention relates to a roller cutter to be mounted on a rock boring head via a journal and a saddle. The journal has two ends that are supposed to be fixed to a conventional saddle. The journal is surrounded by a rotatably carried roller body comprising rows of circumferentially extending cutting means. The rotational axis of the roller cutter inclines an angle $\phi_1$ with respect to the center line of the journal so that a true rolling movement may be obtained between the roller cutter and the rock surface.

14 Claims, 7 Drawing Figures

ROLLER CUTTER WITH A TILTED JOURNAL

BACKGROUND OF SUMMARY OF THE INVENTION

The present invention relates to a roller cutter adapted to be mounted to a boring head via mounting means such as a saddle. The boring head is of the type described in U.S. Pat. No. 4,274,496, which hereby is incorporated in the description, for use in reaming or full-face boring. The center line of the journal of the roller cutter is inclined an angle relative to the base surface of the saddle so that the jacket surface contacting the rock surface is essentially parallel with the base surface.

The prior art roller cutters for boring heads often exploit the fact that a diminishing cone angle on the roller cutter with an increasing distance between the roller cutter and the center of the boring head reduces wear on the roller cutter and power-requirements. The apex of the cone will then coincide with the center of the boring head so that the roller cutter achieves a true rolling movement. It is also previously known to off-set the roller cutter in the horizontal plane in order to influence the fragmentation of the rock surface. Hitherto known devices have disadvantages as they require a large number of roller cutters with different cone angles and a large number of different saddles in order to achieve a true rolling movement and off-setting according to the above-mentioned aspects. The large assortment of roller cutters and saddles required makes the risk of confusion apparent which would negatively affect the drilling operation. A large assortment is not compatible and therefore a storage problem will arise at the place of drilling. The roller cutters and the saddles are expensive and therefore a large assortment is uneconomical to keep. Furthermore it is impossible to rearrange conventional roller cutters that have been unevely worn from, for example, an outer position to an inner position on the boring head due to differences in geometry.

The object of the present invention is to solve the abovementioned problems which object is attained by giving the invention the characterizing features stated in the claims following hereinafter.

BRIEF DESCRIPTION OF THE DRAWINGS

The invention is described below with reference to the accompanying drawings, in which preferred embodiments of the invention are shown by way of example. It is to be understood that these embodiments are only illustrative of the invention and that various modifications thereof may be made within the scope of the claims following hereinafter.

In the drawings

DETAILED DESCRIPTION OF PREFERRED EMBODIMENTS OF THE INVENTION

Figure 1:
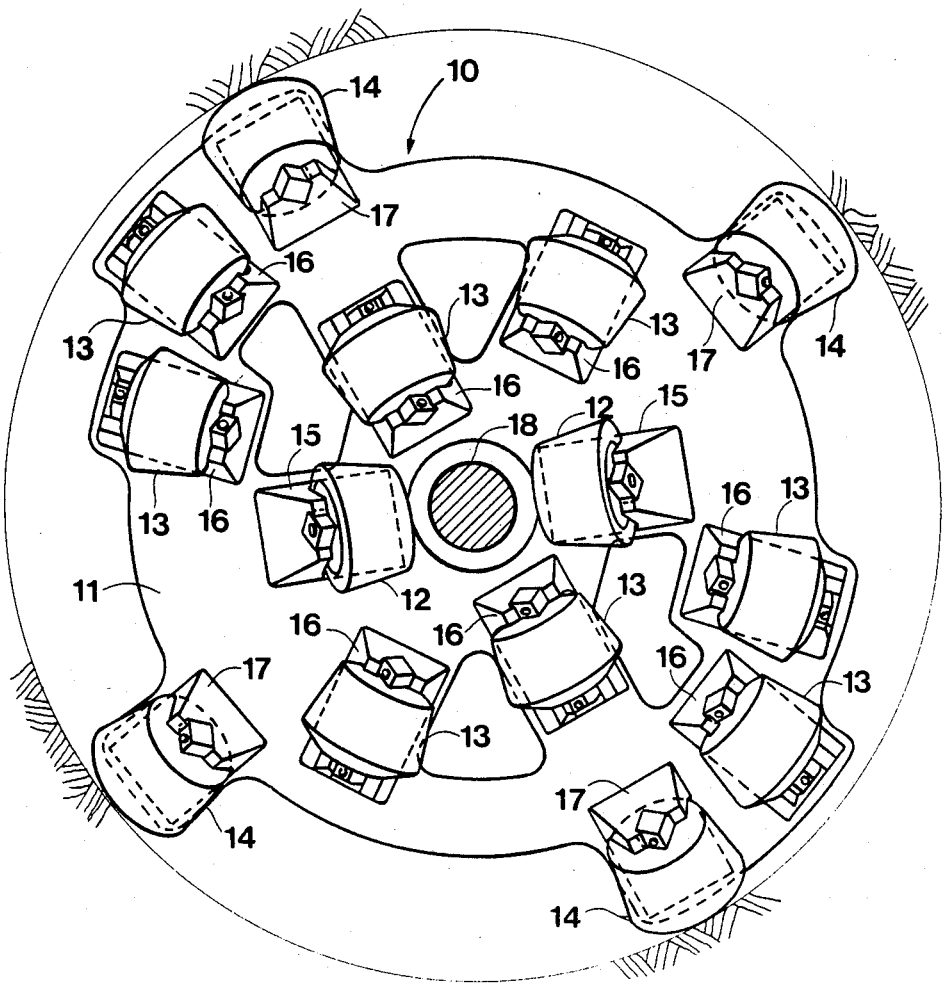
FIG. 1 is a top view of a conventional boring head.

FIG. 1 shows a boring head for reaming generally depicted by the reference numeral 10. The boring head

10 comprises a body 11 on which a plurality of roller cutters 12,13,14 are mounted in mounting means or saddles 15,16,17. The innermost pair of roller cutters 12 are mounted in the innermost pair of saddles 15, the intermediate pairs of roller cutters 13 in the intermediate pairs of saddles 16 and the outermost pairs of roller cutters 14 in the two outermost pairs of saddles 17. The boring head 10 is rotated and forced against an annular surface by means of the stem 18.

The saddles 15–17 are mounted in diametrically opposed pairs on each side of the rotational axis of the boring head 10 and at the same distance from the axis. Each roller cutter 12–14 is rotatably carried in the saddle 15–17 by means of a journal. Each roller cutter is provided with cutting means (e.g., see cutting inserts 27 in FIG. 6 in the form of hard metal inserts which are fitted in bores in the body of the roller cutter. The inserts are positioned in rows which extend circumferentially around the roller cutter.

Figure 2:
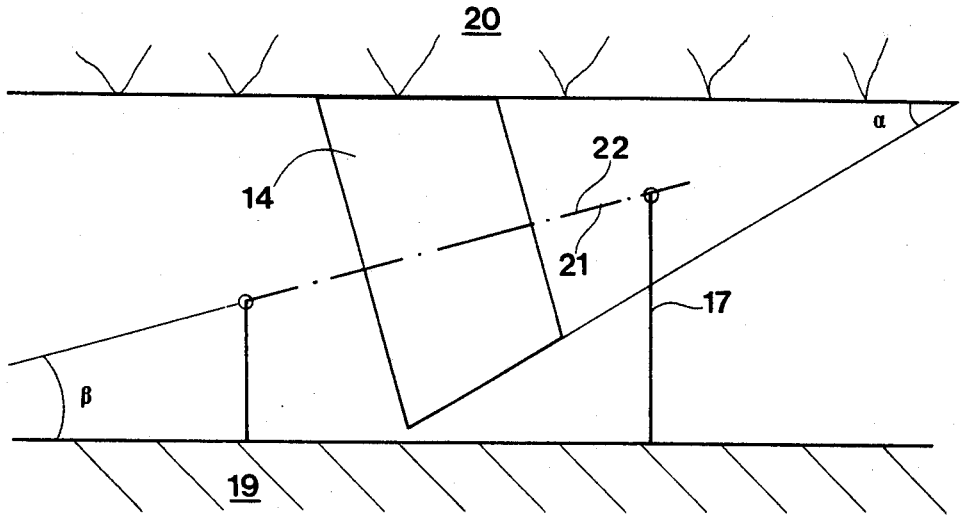
Fig.2 PRIOR ART
FIGS. 2 and 4 are principal sketches of conventional roller cutters in side view and top view, respectively.

In FIG. 2 is shown a conventional roller cutter mounted on the upper surface of the body 11 which is called a base surface 19 which is parallel with the rock surface 20. A saddle, for example an outermost saddle 17, is mounted on the base surface 19 and it holds a roller cutter 14 of a conventional type. The roller cutter 14 is mounted on the saddle 17 via the journal so that the rotational axis 21 coincides with a reference line or centerline 22 of the journal and its points of attachment to the saddle 17. The cone angle of the roller cutter is depicted as $\alpha$ and the angle $\beta$ is the inclination of the journal and its points of attachment with respect to the base surface 19. The center of the boring head lies to the right in the figures.

Figure 3:
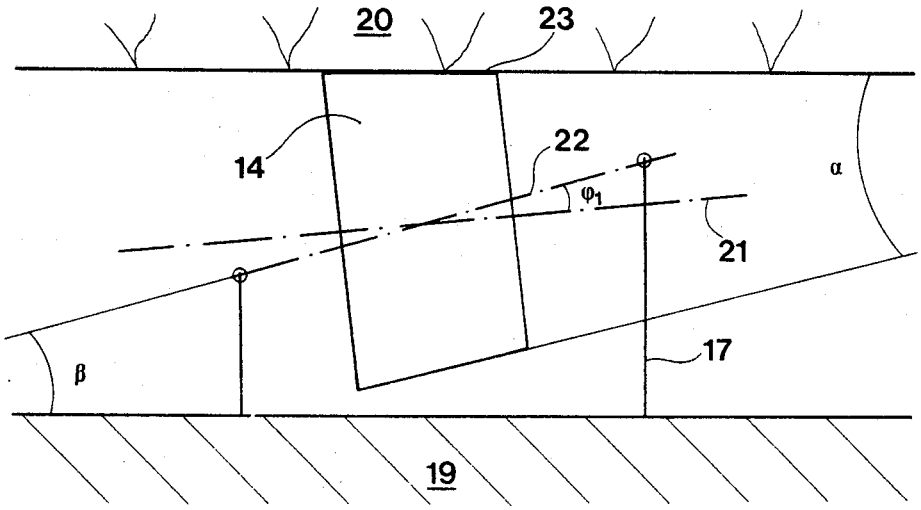
FIGS. 3 and 5 are principle sketches of roller cutters according to the present invention in side view and top view, respectively.

FIG. 3 shows a roller cutter according to the present invention in a side view, for example an outermost roller cutter 14, mounted on a conventional saddle 17, wherein the roller cutter works between the parallel surfaces 19 and 20. The rotational axis 21 of the roller cutter 14 is inclined an angle $\phi_1$ relative to the centerline 22 of the journal as the cutter is viewed from the side (FIG. 3). The angle $\phi_1$ is chosen so that the part 23 of the jacket surface of the roller cutter 14 that contacts the rock surface 20 becomes parallel with the rock surface and so that the cutting means will work the same annular groove in the rock surface.

The size of the angle $\phi_1$ is given by the formula $\phi_1=\beta-\alpha/2$ where $\phi_1$ exceeds zero. The angles $\beta$ and $\alpha$ being defined above are chosen within the intervals $\alpha=0$ to 30 degrees, preferably 10 to 27 degrees and $\beta=0$ to 30 degrees, preferably 5 to 15 degrees, respectively. This geometry gives essentially a true rolling movement with roller cutters whose cone angles are small in spite of the roller cutters being mounted on conventional saddles with a large $\beta$. Thus, the boring operation will run almost without sliding of the roller cutters and, therefore, most of the used power goes into duty. The lack of sliding results in an extension in life length of the parts of the roller cutter, especially of the hard metal inserts. The inclination of the center line of the journal with respect to the rotational axis of the roller cutter makes a placing of the roller cutter anywhere on the body 11 possible and therefore the necessary assortment of cutters and saddles can be held small. The outermost mounted cutters 14 will work more rock per revolution of the boring head than the radially inwards placed cutters 12, 13 so that the cutters 14 will be more worn and therefore the possibility to interchange the outermost cutters and the radially inwards placed cutters 12,13 is a great advantage with the present invention.

Figure 4:
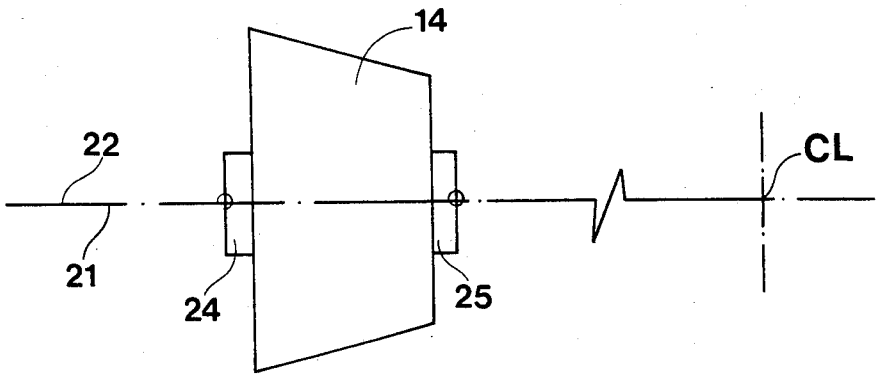
Fig.4 PRIOR ART

FIG. 4 shows a conventional roller cutter in a top view according to FIG. 1 wherein the cutter, for example an outermost roller cutter 14, has a journal with ends 24, 25 whose centerline 22 coincides with rotational axis 21 of the roller cutter and they both intersect the center line of the boring head. Boring with offset is not possible to achieve with this combination of saddle and cutter without special bodies for the purpose.

Figure 5:
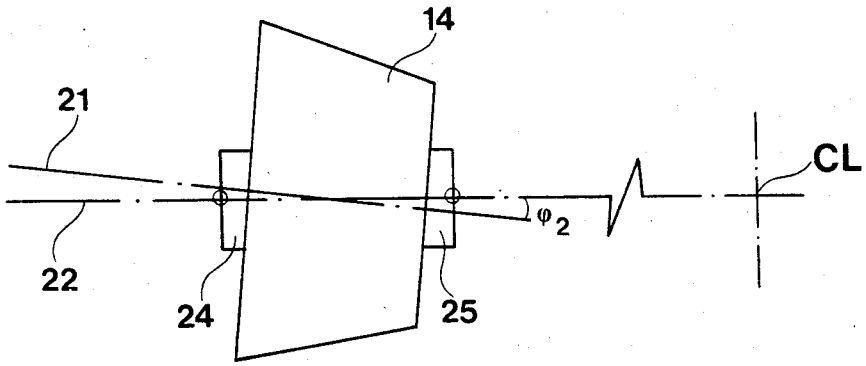

FIG. 5 shows a roller cutter 14 according to the present invention wherein the rotational axis 21 of the cutter is inclined an angle $\phi_2$ relative to the center line 22 of the ends 24,25 of the journal as the cutter is viewed from above. The center line 22 intersects the center of the boring head. Also this cutter 14 is adapted to be mounted in a conventional saddle and the cutter 14 will then rotate in an offset manner in order to tear away the stone ridges occurring between the rows of cutting means, all due to the rotational axis 21 not intersecting the center line CL of the boring head. The shaping of the roller cutter makes it possible to take advantage of the offset boring using an equipment that previously only has been used for conventional boring.

Figure 6:
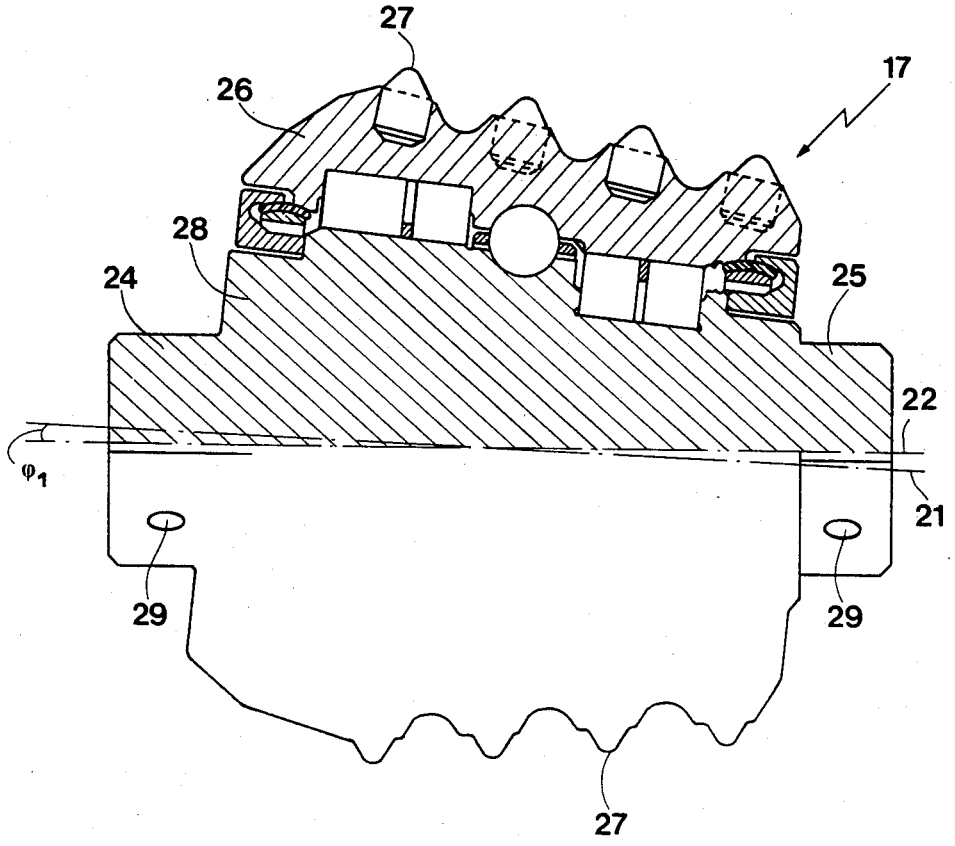
FIGS. 6 and 7 are roller cutters in detail partly in section according to FIGS. 3 and 5, respectively.
Figure 7:
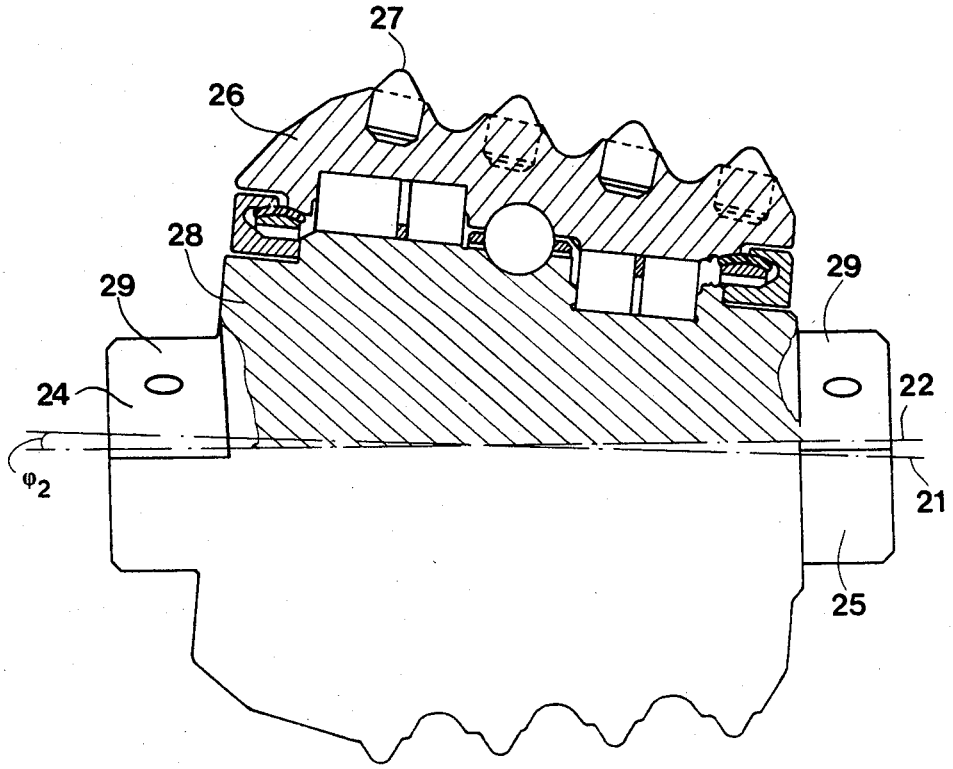

In FIGS. 6 and 7 are shown a vertically and a horizontally inclined roller cutter, respectively, according to the present invention, partly in section. Each cutter comprises a roller body 26 provided with cutting means 27, a journal 28 and therebetween arranged bearing means and seals. The ends 24,25 of the journal 28 which define the reference line 22 are mouted on the points of attachment of the saddle by means of bolts reaching through the mounting holes 29 of the journal. FIG. 6 shows a roller cutter held by a journal whose center line 22 inclines vertically an angle $\phi_1$ relative to the rotational axis 21 of the roller 26, while in FIG. 7 the center line 22 inclines horizontally the angle $\phi_2$ relative to the rotational axis 21. The angle $\phi_2$ is selected within the interval $-14$ to 14 degrees, preferably $-7$ to 7 degrees, but is of course separated from zero degrees.

What I claim is:

1. A boring head comprising:

a boring body rotatable about a main axis of rotation and including a base surface oriented substantially perpendicularly to said main axis, a plurality of mounting means mounted on said base surface, and a plurality of roller cutters mounted on respective ones of said mounting means, each roller cutter comprising a journal including mountable ends mounted in said mounting means, said ends defining a reference line extending generally toward the vicinity of said main axis, and a roller body rotatably carried on said journal and including a frusto-conical jacket surface, said frusto-conical jacket surface defining an apex directed generally toward the vicinity of said main axis and carrying a plurality of circumferentially extending rows of cutting means, said roller body being rotatable on said journal about a secondary axis of rotation oriented at an acute angle with respect to said reference line as said cutter is viewed from the side, such that a forwardmost portion of said jacket surface is oriented so as to lie parallel to an earth formation cut by said boring head, said reference line forming an acute angle with respect to said jacket surface which is larger than said acute angle formed between said axis of rotation and said reference line.

2. A boring head according to claim 1, wherein said acute angle between said axis of rotation and said reference line substantially equals $\beta-\alpha/2$ wherein $\beta$ comprises said acute angle between said reference line and said jacket surface, and $\alpha$ comprises the cone angle of said frusto-conical jacket surface.

3. A boring head according to claim 2, wherein said angle $\beta$ lies in the range of from 0 to 30 degrees, and said angle $\alpha$ lies in the range of from 0 to 40 degrees.

4. A boring head according to claim 3, wherein said angle $\beta$ lies in the range of from 5 to 15 degrees and said angle $\alpha$ lies in the range of from 10 to 27 degrees.

5. A roller cutter to be mounted on a base surface of a boring head via mounting means for full-face boring or reaming, said cutter comprising a journal having mountable ends mountable on the mounting means, said mountable ends defining a reference line, and a roller body rotatably carried on said journal and including a frusto-conical jacket surface, said frusto-conical jacket surface carrying a plurality of circumferentially extending rows of cutting means, said roller body being rotatable on said journal about an axis of rotation oriented at an acute angle with respect to said reference line as said cutter is viewed from the side, said reference line forming an acute angle with respect to said conical jacket surface which is larger than said acute angle formed between said axis of rotation and said reference line.

6. A roller cutter according to claim 5, wherein said acute angle between said axis of rotation and said reference line substantially equals $\beta-\alpha/2$ wherein $\beta$ comprises said acute angle between said reference line and said jacket surface, and $\alpha$ comprises the cone angle of said frusto-conical jacket surface.

7. A roller cutter according to claim 6, wherein said angle $\beta$ lies in the range of from 0 to 30 degrees, and said angle $\alpha$ lies in the range of from 0 to 40 degrees.

8. A roller cutter according to claim 7 wherein said angle $\beta$ lies in the range of from 5 to 15 degrees and said angle $\alpha$ lies in the range of from 10 to 27 degrees.

9. A boring head comprising:

a boring body rotatable about a main axis of rotation and including a base surface oriented substantially perpendicularly to said main axis, a plurality of mounting means mounted on said base surface, and a plurality of roller cutters mounted on respective ones of said mounting means, each roller cutter comprising a journal including mountable ends mounted in said mounting means, said ends defining a reference line extending generally toward the vicinity of said main axis, and a roller body rotatably carried on said journal and including a frusto-conical jacket surface, said frusto-conical jacket surface defining an apex directed generally toward the vicinity of said main axis and carrying a plurality of circumferentially extending rows of cutting means, a forwardmost portion of said jacket surface oriented so as to lie parallel to an earth formation cut by said boring head, said roller body being rotatable on said journal about a secondary axis of rotation oriented at an acute angle with respect to said reference line as said cutter is viewed from above in a direction parallel to said main axis, said reference line forming an acute angle with respect to said jacket surface which is larger than said acute angle formed between said axis of rotation and said reference line.

10. A boring head according to claim 9, wherein said acute angle formed between said axis of rotation and said reference line lies in the range of from −14 to +14 degrees, exclusive of zero degrees.

11. A boring head according to claim 9, wherein said acute angle formed between said axis of rotation and said reference line lies in the range of from −7 to +7 degrees, exclusively of zero degrees.

12. A roller cutter to be mounted on a base surface of a boring head via mounting means for full-face boring or reaming, said cutter comprising a journal having mountable ends mountable on the mounting means, said mountable ends defining a reference line, and a roller body rotatably carried on said journal and including a frust-conical jacket surface, said frusto-conical jacket surface carrying a plurality of circumferentially extending rows of cutting means, said roller body being rotatable on said journal about an axis of rotation oriented at an acute angle with respect to said reference line as said cutter is viewed from above, said reference line forming an acute angle with respect to said conical jacket surface which is larger than said acute angle formed between said axis of rotation and said reference line.

13. A boring head according to claim 12, wherein said acute angle formed between said axis of rotation and said reference line lies in the range of from −14 to +14 degrees, exclusive of zero degrees.

14. A boring head according to claim 12, wherein said acute angle formed between said axis of rotation and said reference line lies in the range of from −7 to +7 degrees, exclusive of zero degrees.

* * * * *